US008743005B2

(12) United States Patent
Stuart

(10) Patent No.: US 8,743,005 B2
(45) Date of Patent: Jun. 3, 2014

(54) LOW-ASPECT ANTENNA HAVING A VERTICAL ELECTRIC DIPOLE FIELD PATTERN

(75) Inventor: Howard R. Stuart, Glen Ridge, NJ (US)

(73) Assignee: LGS Innovations LLC, Herndon, VA (US)

( * ) Notice: Subject to any disclaimer, the term of this patent is extended or adjusted under 35 U.S.C. 154(b) by 287 days.

(21) Appl. No.: 13/195,244

(22) Filed: Aug. 1, 2011

(65) Prior Publication Data

US 2013/0033405 A1 Feb. 7, 2013

(51) Int. Cl.
*H01Q 7/08* (2006.01)

(52) U.S. Cl.
USPC ..... 343/788; 343/866

(58) Field of Classification Search
USPC ..... 343/866, 787, 788, 793
See application file for complete search history.

(56) References Cited

U.S. PATENT DOCUMENTS

| | | | | |
|---|---|---|---|---|
| 3,540,047 | A | 11/1970 | Walser et al. | |
| 6,731,246 | B2 * | 5/2004 | Parsche et al. | 343/741 |
| 6,992,630 | B2 * | 1/2006 | Parsche | 343/700 MS |
| 8,378,911 | B2 * | 2/2013 | Eray et al. | 343/788 |

OTHER PUBLICATIONS

R. M. Walser and W. Kang, "Fabrication and Properties of Microforged Ferromagnetic Nanoflakes," IEEE Trans. on Magnetics, vol. 34 (Jul. 1998) pp. 1144-1146.

H.R. Stuart and A.D. Yaghjian, "Approaching the Lower Bounds on Q for Electrically Small Electric-Dipole Antennas Using High Permeability Shells," IEEE Trans. Ant. Prop., vol. 58 (2010) pp. 3865-3872.

Guo-Min Yang et al., "Planar Annular Ring Antennas With Multilayer Self-Biased NiCo-Ferrite Films Loading," IEEE Trans. Ant. Prop., vol. 58 (Mar. 2010) pp. 648-655.

"Antenna Loading Materials," http://www.utexas.edu/research/cemd/html/antenna_loading_materials.htm (no date provided).

R.M. Walser, "Metamaterials: An Introduction," in W.S. Weiglhofer and A. Lakhtakia, eds., Introduction to Complex Mediums for Optics and Electromagnetics, SPIE Press, Bellingham, Washington, 2003, pp. 295-316.

* cited by examiner

*Primary Examiner* — Tan Ho
(74) *Attorney, Agent, or Firm* — Baker and Hostetler LLP

(57) ABSTRACT

An antenna comprises a ring-shaped radiofrequency resonator that defines a path for a circulating magnetic current. In an implementation, the resonator has a height of no more than 2% of an operating wavelength, and it has an electromagnetic resonance at the operating frequency. In an implementation, the antenna is of a type having a vertical, short electric dipole radiation or sensitivity pattern. It comprises, as the dominant radiative element, a ring of material disposed transverse to the vertical dipole axis and having an average magnetic permeability more than ten times the magnetic permeability of air. The ring has a maximum outer diameter and a height that is less than the maximum outer diameter. The antenna further includes a feed structure adapted to couple radiofrequency energy into and/or out of a magnetic current circulating in the ring.

5 Claims, 7 Drawing Sheets

(A)

(B)

LOW-ASPECT ANTENNA HAVING A VERTICAL ELECTRIC DIPOLE FIELD PATTERN

FIELD OF THE INVENTION

The invention relates to antennas, and more particularly to antennas suitable for use in communications at microwave frequencies.

ART BACKGROUND

Antennas are often mounted on the external surfaces of ground vehicles and aircraft. In such situations, it is often desirable for the antenna structure to have the lowest aspect possible. By "aspect" is meant the ratio of height, i.e. extent perpendicular to the mounting surface, to lateral extent, i.e., extent parallel to the mounting surface. For example, a small aspect may be desirable to minimize aerodynamic drag, to reduce visual signature, to improve aesthetic appearance, or for other reasons. In some cases, it may be desirable to conform the antenna to the shape of the mounting surface. The smaller the aspect, the more completely such a goal may be achieved.

However, reducing the antenna aspect may also entail reducing the performance of the antenna. For example, many applications require an antenna having a radiation pattern (in transmission) or sensitivity pattern (in reception) characteristic of an antenna that is electrically polarized perpendicular to the mounting surface. In order to be able to radiate and/or to receive energy polarized along the perpendicular direction, an electrically polarized antenna must extend for at least some height above the mounting surface. Reducing the height will typically reduce the bandwidth and/or the efficiency of the antenna.

Accordingly, there is a need for antennas having very small aspects, but that nevertheless have good performance characteristics such as bandwidth and efficiency. In particular, there is a need for antennas having the aforesaid properties, and further exhibiting radiation or sensitivity patterns characteristic of an antenna that is electrically polarized perpendicular to the mounting surface.

SUMMARY OF THE INVENTION

I have invented such an antenna. With reference to an operating frequency that corresponds to a vacuum wavelength λ, my antenna in one aspect comprises a ring-shaped radiofrequency (RF) resonator that defines a path for a circulating magnetic current. The resonator has a height of no more than λ/50, and it has an electromagnetic resonance at the operating frequency.

In another aspect, my antenna is a type of antenna having a vertical, short electric dipole radiation or sensitivity pattern. It comprises, as the dominant radiative element, a ring of material disposed transverse to the vertical dipole axis and having an average magnetic permeability more than ten times the magnetic permeability of air. By "dominant" is meant that most of the RF power radiated by the antenna (when operated in transmission) at an operating frequency is directly attributable to radiation by the magnetic ring. The ring has a maximum outer diameter and a height that is less than the maximum outer diameter. My antenna further includes a feed structure adapted to couple RF energy into and/or out of a magnetic current circulating in the ring.

In specific embodiments, the ring material has an average relative magnetic permeability of at least 10. By "relative magnetic permeability" is meant the ratio of the magnetic permeability to the magnetic permeability of air.

Magnetic loss, particularly at high frequencies, is often described in terms of a complex magnetic permeability having real and imaginary parts whose ratio is referred to as the "loss tangent". To avoid confusion between the possible meanings of "magnetic permeability", whenever discussing the complex permeability in the sections that follow, I will explicitly refer to it as such, or to its real and imaginary parts.

In specific embodiments, the ring has a height of no more than λ/50.

In specific embodiments, the ring material has a loss tangent of no more than 0.1.

DETAILED DESCRIPTION

As noted above, performance limitations become significant as the height of a vertically polarized antenna height is reduced. One illustration of this effect is provided by the simple example of a vertically polarized monopole antenna mounted on a ground plane. It is well known that such an antenna performs well when its length is near λ/4, λ being the operating wavelength. (Unless stated otherwise, all references to "wavelength" will mean the vacuum wavelength corresponding to a particular RF frequency.) By adding an inductive load near its base, the antenna can be made as short as λ/20. However, if the antenna is made substantially shorter, its efficiency will be significantly degraded.

The monopole antenna can also be shortened by covering it with an electrically conductive cap, which may e.g. have the form of a circular disk. Such a configuration is referred to as a "top-loaded monopole". Top-loaded monopoles have been demonstrated with a height of λ/12 and an impedance matched bandwidth of one octave or more. The height can be reduced further at the cost of bandwidth. However, as will be seen below, there is a limit to how far the height can be reduced while maintaining acceptable performance.

One important performance parameter for antennas is the Q-factor, which (at least when describing a single resonance) is inversely proportional to the fractional bandwidth of the antenna:

$$Q \propto \frac{1}{(\Delta f / f_0)},$$

where Δf is an appropriately defined operating bandwidth of the antenna and $f_0$ is the resonant frequency of the antenna. For most practical applications, it is desirable for Q to be relatively small, e.g. less than 20, so that the antenna can operate over a reasonable bandwidth.

Antenna designers have found that the achievable values of Q are limited by the antenna dimensions. That is, for a given set of dimensions, Q cannot be made smaller than a lower bound $Q_{lb}$.

Theoretical studies have provided estimates of $Q_{lb}$ for various antenna geometries. One such study was recently published in M. Gustafsson et al., "Illustrations of New Physical Bounds on Linearly Polarized Antennas," *IEEE Trans. Ant. Prop.*, vol. 57, 1319-1327 (2009), and another in A. D. Yaghjian et al., "Lower Bounds on the Q of Electrically Small Dipole Antennas," *IEEE Trans. Ant. Prop.*, vol. 58, 3114-3121 (2010). According to those studies, $Q_{lb}$ for a small dipole antenna of arbitrary shape that does not include magnetic materials is given by the expression $Q_{lb}=6\pi/fVk^3$, where f is a shape factor, V is the volume of the antenna, and k is the wavenumber, i.e., 2π/λ.

For a cylindrical antenna, the quantity f is the electrostatic polarizability of a solid conductor occupying the volume V, divided by V. Even more simply, assuming a capped monopole antenna having a height h above the ground plane that is less than half the radius r of the circular cap, f is approximately $$1 + \frac{8h}{\pi r}.$$

Figure 1:
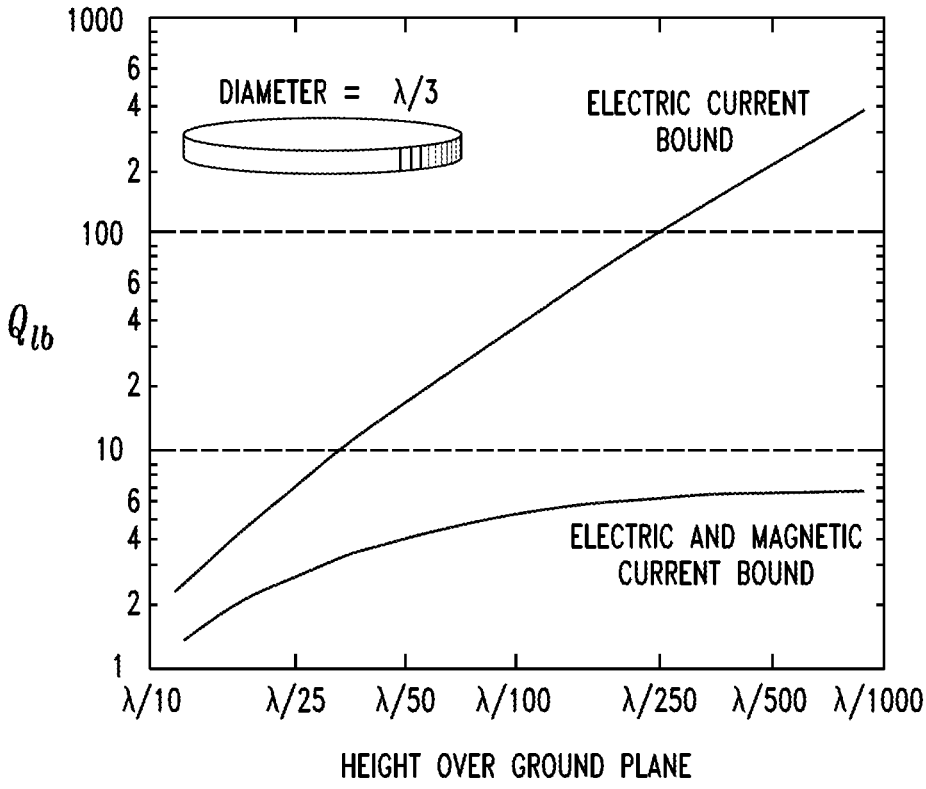
FIG. 1 is a plot of the theoretical lower bound $Q_{lb}$ on the Q-factor of an antenna, versus the height of the antenna, for vertically polarized, electrically short cylindrical dipole antennas of diameter λ/3, where λ is the operating wavelength.

Using the preceding formulas, I have plotted $Q_{lb}$ versus h in FIG. 1 for a capped monopole of diameter λ/3.

The result is the upper curve in the figure, labeled "electric current bound". With reference to the figure, it will be seen that as expected, $Q_{lb}$ increases as the height is decreased. However, because the antenna used for this example has a relatively large diameter, $Q_{lb}$ remains below 20 even when h reaches the relatively low value of λ/50. Nevertheless, it will also be seen that $Q_{lb}$ continues to rise rapidly with further decreases in the height of the antenna.

I have found that on the contrary, good performance can be maintained even when h is substantially smaller than λ/50, in antennas of a design that I will now describe.

My antenna produces vertically polarized electric dipole radiation from a circulating loop of magnetic polarization current. More specifically, a thin slab of material is provided, having a very high relative magnetic permeability $\mu_r$. The magnetic material supports a resonant mode characterized by the circulating magnetic current. The circulating magnetic current induces an electric dipole moment whose magnitude depends on the surface area enclosed by the magnetic current loop. Because of the induced electric dipole moment, the radiation pattern of the magnetic current loop is similar to that of vertically polarized electric dipole radiation.

The slab can be placed directly on a ground plane without impairing the performance. The slab thickness that is required will depend upon the value of $\mu_r$: higher permeability will permit the use of thinner slabs.

The resonant mode of the slab can be coupled to a conventional electrically conductive feed line using a feed geometry that couples the electric currents in the feed line to the magnetic fields in the magnetic material. Appropriate geometries are well known and need not be described here in detail.

The feed line is impedance matched to the slab using well-known techniques, which may include the use of simple dimensional tuning as well as lumped element matching networks.

As will be discussed in more detail below, my numerical simulations have shown, for example, that using a slab having a $\mu_r$ of 150, it is possible to achieve for h=λ/400 a Q-factor of about 11 in an antenna of diameter λ/3 coupled to a 50Ω transmission line.

As noted, the theoretical expression for $Q_{lb}$ provided above is applicable to antennas that incorporate no magnetic material. A more general expression, for the case in which both electric and magnetic currents may be present in the antenna, is $$Q_{lb} = 6\pi / fVk^3 \left(1 - \frac{1}{f}\right).$$

It will be seen from the bracketed expression (which is less than 1, because f will always be greater than 1) that the lower bound on Q can be made smaller if the possibility of magnetic currents is introduced.

Using the preceding formula, I have plotted $Q_{lb}$ versus h in FIG. 1 for an antenna of diameter λ/3 that incorporates magnetic material so that both electric and magnetic currents can be supported. The result is the lower curve in the figure, labeled "electric and magnetic current bound". A comparison of the lower curve with the upper curve shows that $Q_{lb}$ is somewhat reduced for height values of λ/10 and above, but the reduction in $Q_{lb}$ grows rapidly as the height continues to decrease. It will be seen that for very small values of h, $Q_{lb}$ approaches a saturation value that is independent of the height, and that is less than 10 in the example of FIG. 1. This suggests that by using magnetic materials, it will be possible to make an antenna that has good performance even with a vertical height that is a very small fraction of the operating wavelength.

Figure 2:
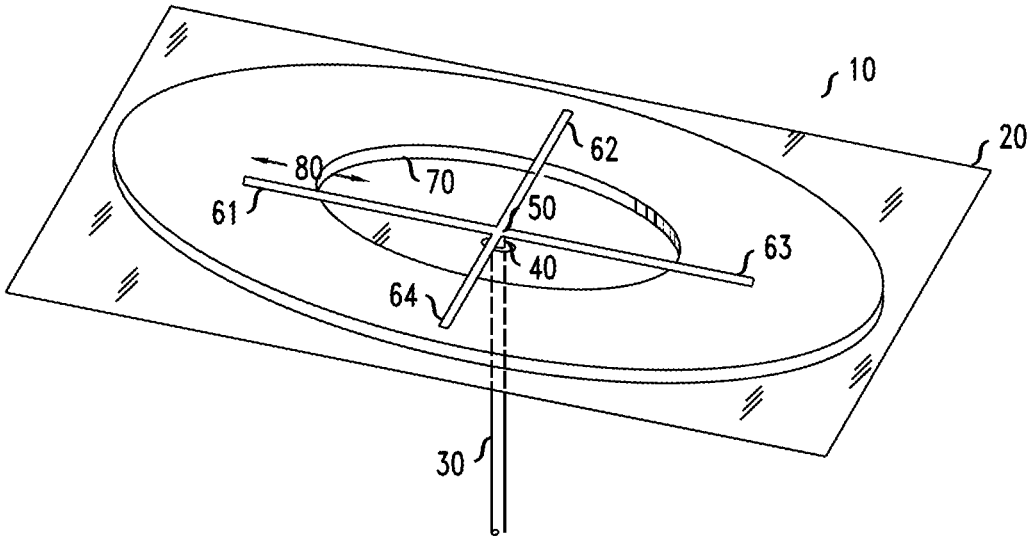
FIG. 2 is a simplified drawing of my new antenna, in one embodiment.

FIG. 2 provides one example of a new antenna designed to achieve the benefits described above. As seen in the figure, a flat magnetic ring 10 rests on a ground plane 20. By "flat" is meant that the ring has substantially planar upper and lower surfaces and a vertical thickness that is less than its outer diameter.

For good performance, the ground plane should be at least the diameter of the magnetic ring, and preferable two or more times the diameter of the ring. The exact size of the ground plane is not critical, but up to a size that is several times the diameter of the magnetic ring, the size of the ground plane might affect the performance of the antenna. In many applications, the surface on which the antenna is mounted will serve as a large ground plane, i.e., a ground plane that is effectively infinite in extent. It should also be noted that other embodiments, described below, omit the ground plane.

The antenna has a feed structure for coupling an RF signal into the antenna for transmission, or for coupling an RF signal out of the antenna for reception. As seen in the figure, the feed structure consists of a coaxial transmission line 30, extending through hole 40 in the ground plane via a short post 50 having a height approximately equal to the thickness of the magnetic ring. Attached to the top of post 50 are four thin, mutually perpendicular conducting plates 61-64, which extend radially from the post to rest on the upper surface of the ring a short overlap distance 80 beyond inner edge 70 of the ring. In one configuration that is well known in the art, the inner conductor of the coaxial cable is electrically connected to the feed plates 61-64 so that all four feed plates are driven in phase. The outer conductor is electrically connected to the ground plane.

If feed plates 61-64 cannot be made thin enough to present a tolerable vertical height above the upper surface of ring 10, they can be accommodated within appropriately shaped depressions in the upper surface of the ring, so that the upper surfaces of the feed plates are made flush with the upper surface of the ring.

For maximum power transfer, is desirable to match the antenna impedance as measured at post 50 to the impedance of the transmission line that feeds the antenna. This antenna impedance is dependent on the overlap distance 80. In practice, therefore, it will be advantageous to adjust the overlap distance until the best impedance match is reached. Such adjustment is well known to those skilled in the art and can be achieved with minimal experimentation.

I performed numerical simulations to evaluate the theoretical performance of an antenna as described above. The simulated antenna had an outer radius of 20 cm, an inner radius of 10 cm, and a height of 3 mm. The feed plates extended 12.5 cm from the center of the post, corresponding to an overlap distance of 2.5 cm. The magnetic material of which the ring was composed had a relative magnetic permeability of 150 and a relative electric permittivity of 3. The operating bandwidth included, near its low end, a frequency of 250 MHz, corresponding to an operating wavelength of 1.2 m. At that frequency, the height of the antenna was $\lambda/400$.

The numerical simulations verified that the antenna would radiate like a short vertical electric dipole over the operating bandwidth.

Figure 3:
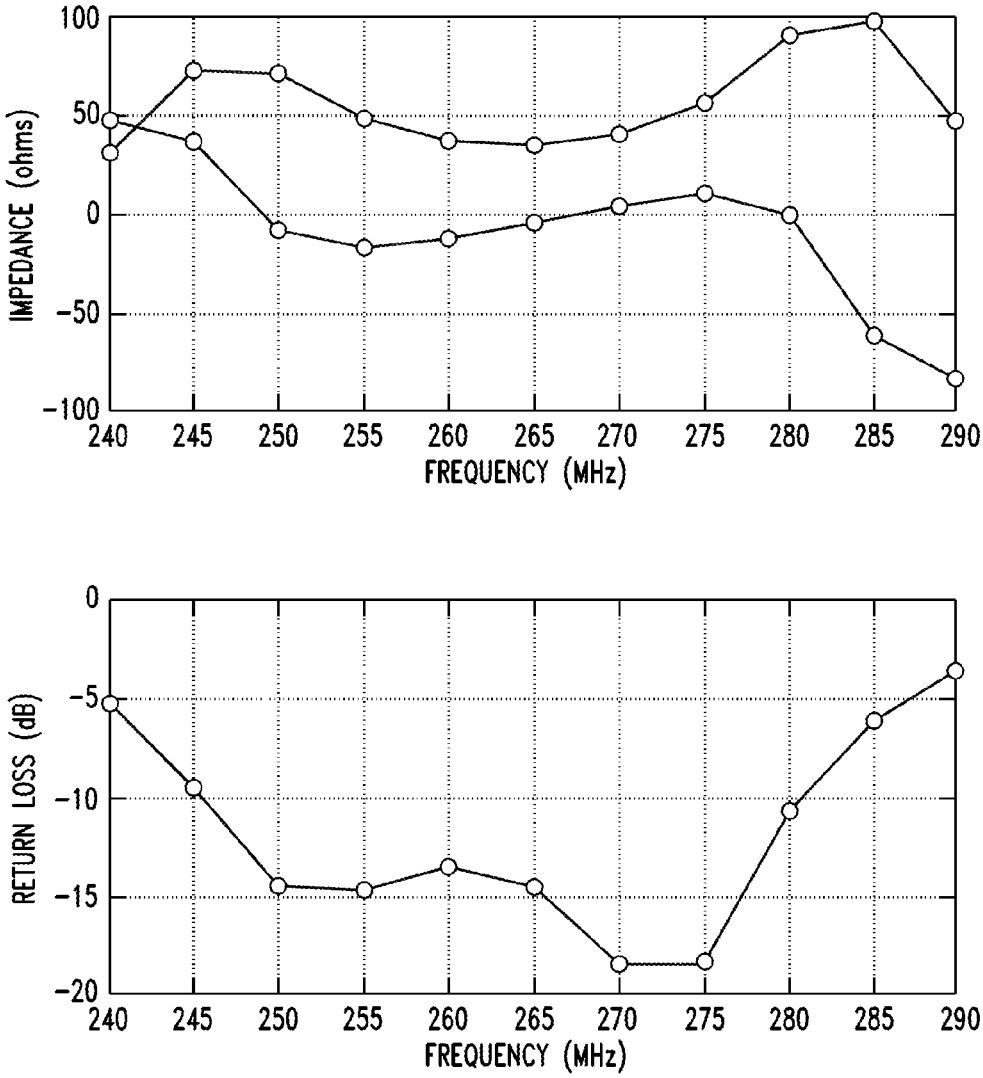
FIG. 3 provides a pair of plots, due to numerical simulations, that characterize an exemplary implementation of the antenna of FIG. 2. The upper portion of the figure is a plot of impedance versus frequency, and the lower portion of the figure is a plot of return loss versus frequency. In the upper (impedance) plot, the upper curve represents the real part of the complex impedance, and the lower curve represents the imaginary part. The figure indicates, among other things, a good impedance match to a 50Ω transmission line over a fractional bandwidth of about 13% centered near 265 MHz.

FIG. 3 provides a plot of impedance versus frequency, and below it a plot of return loss versus frequency, for the simulated antenna. In the upper (impedance) plot, the upper curve represents the real part of the complex impedance, and the lower curve represents the imaginary part. The return loss was calculated assuming a drive impedance of 50Ω. The return loss was calculated as the ratio (expressed in decibels) of reflected to incident RF power, where the reflected power is the power reflected from the antenna back into the transmission line.

It will be seen from the figure that the simulated antenna was impedance matched to the 50Ω transmission line over a fractional bandwidth of about 13% centered near 265 MHz.

Magnetic materials generally exhibit loss due to the dissipation of energy when magnetization effects within the materials oscillate at radio frequencies. Such loss is generally expressed as the ratio of the imaginary part to the real part of the complex magnetic permeability. Such a ratio is referred to as the "loss tangent." In the simulations of FIG. 3, we assumed zero magnetic loss in the ring material. Introduction of a small amount of loss, e.g. a loss tangent less than 0.1, would have an insubstantial effect on the design parameters of the antenna, but it could substantially reduce the radiation efficiency of the antenna. For example, our simulations show that with a loss tangent of 0.05, the radiation efficiency drops from 100% to about 50%.

It should be noted that for effective power transfer between the transmission line and the magnetic ring, the antenna needs to be operated at or near resonance. The simulations of FIG. 3, for example, were based on an antenna in which the magnetic ring has a resonance near 257 MHz. For fixed values of the relative magnetic permeability $\mu_r$ and the relative electric permittivity $\in_r$, the magnetic ring can be scaled for a wide range of resonant frequencies, simply by maintaining the height and the inner and outer radii constant when normalized to the resonant frequency. (For all of the simulated results presented here, the electric permittivity is fixed at $\in_r=3$.)

However, the normalized dimensions for which resonance is achieved are dependent on the magnetic permeability of the ring material. As a consequence, the degree to which the height and lateral extent of the antenna can be minimized (relative to the resonant frequency) is limited, in a practical sense, by the magnetic permeabilities of available magnetic materials that are suitable for use in the magnetic ring. More will be said, below, about suitable materials.

For example, the simulations of FIG. 3 were based on a ring structure having a radius (i.e., 20 cm) of one-sixth the resonant wavelength. Raising the relative magnetic permeability $\mu_r$ above 150 would permit the normalized height, or the normalized radius, or some combination of the two, to be reduced while still providing a resonant structure.

On the other hand, decreasing the permeability below 150 would require the dimensions to be increased, relative to wavelength, in order to achieve resonance. For example, our simulations show that the same structure (i.e., with constant absolute dimensions as stated above) would resonate at 291 MHz for $\mu_r=100$ and at 403 MHz for $\mu_r=50$. (It will be understood that relative to 257 MHz, the resonant frequency is increased by respective factors of 113% and 157%, and likewise the dimensions relative to the resonant wavelength.) Conversely, maintaining the permeability at $\mu_r=50$ but doubling the height of the ring to 6 mm would reduce the resonant frequency of the ring from 403 MHz to 291 MHz.

We have observed that reducing the inner radius of the ring (i.e., effectively filling in the center hole of the ring) will also reduce the resonant frequency, but we found that this effect is relatively small. For example, reducing the inner radius in our simulations from 10 cm to 5 cm decreased the resonant frequency by no more than a few MHz. In a practical design, decreasing the size of the center hole would probably not be a cost-effective strategy for reducing the resonant frequency, because it would necessitate adding a relatively large amount of expensive material in order to obtain a relatively small benefit.

Figure 4:
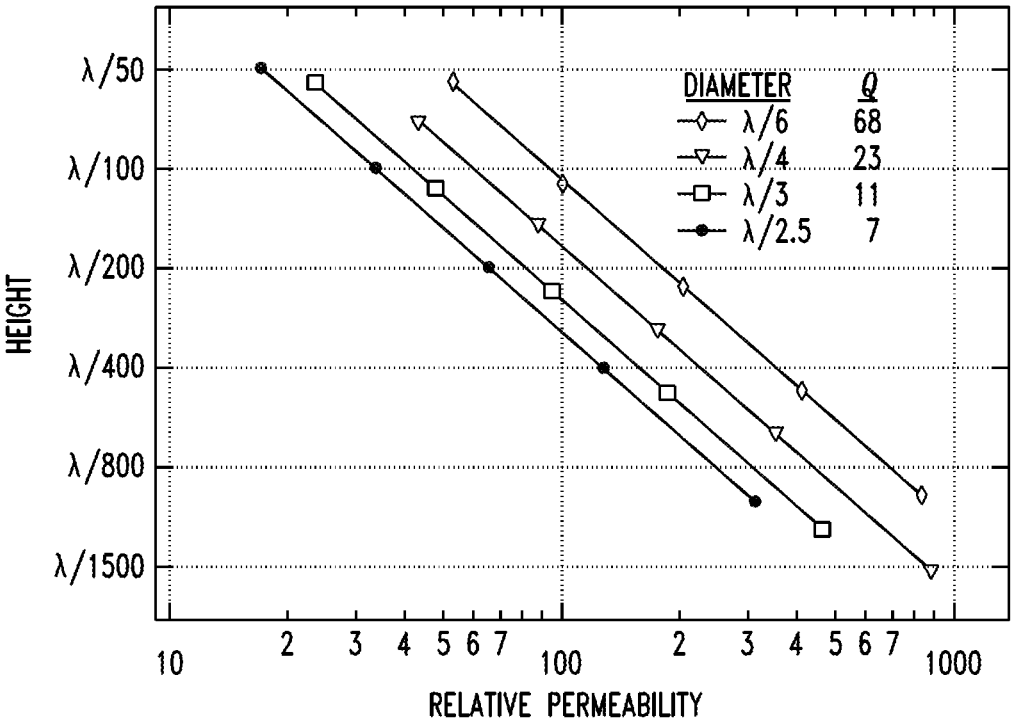
FIG. 4 provides a group of four plots, due to numerical simulation, of the height of the magnetic ring in the exemplary antenna implementation, versus the relative permeability of the magnetic ring material. The height is normalized to the wavelength at the resonant frequency of the ring. The uppermost plot is for a normalized ring diameter of ⅙; the next plot for a normalized diameter of ¼; the next for ⅓; and the lowermost plot is for a normalized diameter of ⅔.

FIG. 4 provides a further understanding of the relationship between the normalized dimensions of the ring at resonance and the relative magnetic permeability. In the figure are seen four plots of relative permeability versus the normalized height of the ring. The uppermost plot is for a normalized ring diameter of ⅙; the next plot for a normalized diameter of ¼; the next for ⅓; and the lowermost plot is for a normalized diameter of ⅔. In each plot, the normalization is relative to the wavelength at the resonant frequency of the ring. The plots were derived from numerical eigenmode simulations of a flat ring of magnetic material as described above. In all cases illustrated, the electric permittivity is assumed to be 3.

Given a particular normalized ring diameter and a desired ring height, FIG. 4 can be consulted to determine the magnetic permeability required to achieve the specified dimensions, or conversely, the height achievable for a given permeability. As will be evident from the figure, shorter heights (at fixed ring diameter) require larger values of the permeability, whereas for a given height, the required permeability decreases if the ring diameter is increased.

It will be seen in the figure that if the ring diameter is made as large as 0.4λ (corresponding to the leftmost curve in the figure), a ring height of λ/50, or even less, can be achieved with a relative permeability that is somewhat less than 20. More generally, I believe that for at least some applications, implementations of my antenna will offer valuable advantages over conventional designs if they incorporate magnetic materials having permeabilities of 10 or more. The greatest advantages will be achieved for ring heights of λ/200 or less, particularly if radiation efficiency greater than 50% and Q-factor less than 20 can be provided, because there are no currently known designs for vertical, electrically polarized antennas that can meet these performance criteria. As seen in the figure, ring heights of λ/200 are achievable for the illustrated ring diameters if magnetic material can be provided with a relative permeability in the approximate range 60-200. The feasibility of the above-mentioned efficiency and Q-factor is discussed below.

In the legend to FIG. 4, I have listed the Q-factor predicted for each respective ring diameter. The values are approximate values of the Q-factor that are most accurate for heights below 0.01λ. Above that height, the Q-factor decreases slightly, e.g. by 5%-10%.

Figure 5:
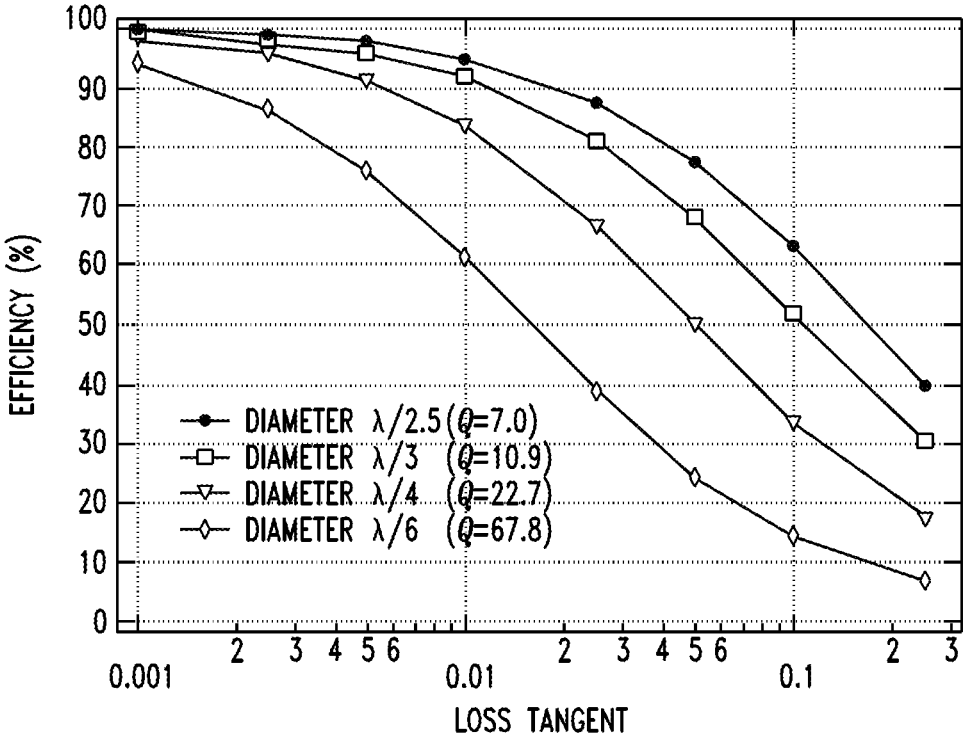
FIG. 5 is a plot, due to numerical simulations, of the radiation efficiency of the exemplary antenna implementation at resonance, versus the loss tangent of the magnetic ring material, for four different normalized ring diameters. The simulations were based on an eigenmode calculation that took into consideration only the magnetic ring, and omitted the antenna feed structure.

As mentioned above, the radiation efficiency of the antenna decreases with increasing loss tangent of the magnetic material. FIG. 5 plots the radiation efficiency at resonance versus loss tangent for four different normalized ring diameters, as determined from numerical simulations. The inner radius of the ring was fixed at one-half the outer radius. The ring height was assumed to be much smaller than the width of the ring; i.e., in a regime in which the efficiency has only a very weak dependence on the height.

FIG. 5 was based on an eigenmode calculation that took into consideration only the magnetic ring, and omitted the antenna feed structure. Because the feed structure generally perturbs the antenna structure somewhat, in a manner that is electromagnetically significant, it would be expected, in practice, to add a modest amount of additional loss.

The uppermost curve in the figure represents a normalized ring diameter of ⅔, the next curve ⅓, the next curve ¼, and the lowermost curve, a normalized ring diameter of ⅙. In the figure, the legend indicates the radiation Q factor that we calculated for each resonant mode, assuming no loss (i.e., a loss tangent of 0). As a general rule, the lower the Q factor, the better the loss tolerance of the antenna structure.

It will be seen from the figure that for a normalized ring diameter of 0.4, efficiencies greater than 50% are predicted for loss tangents less than about 0.2, with more stringent limits on the loss tangent for smaller ring diameters. It will also be seen that a Q-factor less than 22.7 is predicted for normalized ring diameters greater than 0.25, and that a Q-factor less than 10.9 is predicted for normalized ring diameters greater than 0.33.

With further reference to FIG. 5, it will be seen that for a normalized ring diameter of 0.33 (i.e., the second curve from the top), the predicted efficiency is 67% for a loss tangent of 0.05 and 91% for a loss tangent of 0.01. As noted above, this prediction is somewhat unrealistic, because it fails to take into account the loss due to the feed structure.

Figure 6:
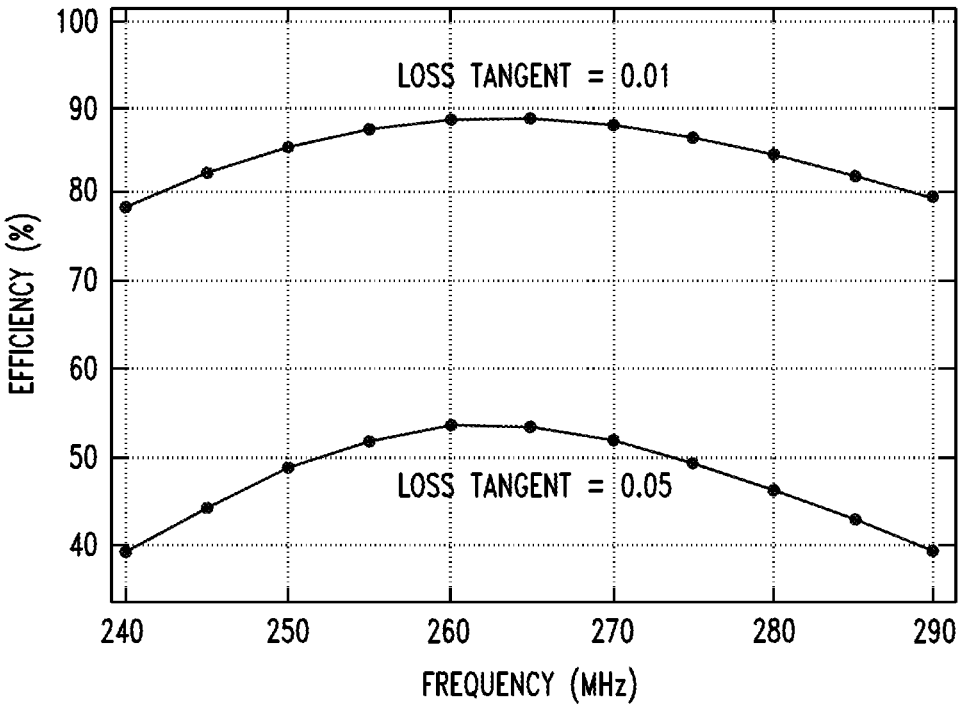
FIG. 6 provides two plots, due to numerical simulations, of the radiation efficiency of the exemplary antenna implementation versus frequency. One plot is for a loss tangent of 0.01, and the other plot is for a loss tangent of 0.05. The numerical simulation took into account the loss due to the antenna feed structure.

FIG. 6 provides greater insight into the relationship between efficiency, loss tangent, and operating frequency (in a resonant mode) for the antenna of FIG. 5 having a normalized ring diameter of 0.33. FIG. 6 provides two plots of efficiency versus frequency, one for a loss tangent of 0.01 and the other for a loss tangent of 0.05. The plots were derived from an antenna simulation taking into account the loss due to the feed structure. It will be seen from the lower plot that the efficiency for a loss tangent of 0.05 now falls in the range 45%-53% depending on frequency, and the efficiency for a loss tangent of 0.01 now falls in the 82%-89% depending on frequency. For the loss tangent of 0.01, it will be seen that the peak efficiency has not fallen far below the 91% efficiency predicted by the eigenmode simulation of FIG. 5. On the other hand, raising the loss tangent to 0.05 increases sensitivity to the feed lines enough to cause the peak efficiency to fall significantly below the 67% value predicted in FIG. 5.

Broadly speaking, I believe that the implementations of my antenna having the most widespread uses will have normalized ring heights of 0.02 or less, normalized ring diameters of 0.5 or less, Q-factors of 20 or less, and radiation efficiencies of 10% or more. For low aspect, the ring height will advantageously be less than the maximum ring diameter. For very low aspect, the ring height will advantageously be 4% or less of the maximum ring diameter. I believe that these criteria will be achievable using, for example, magnetic materials having relative magnetic permeabilities of 10 or more, loss tangents of 0.1 or less, and electric permittivities of 10 or less.

Materials having values of relative magnetic permeability greater than 10, particularly iron and other ferromagnetic materials, are well known. However, bulk materials having moderate to high electrical conductivity are unsuitable because eddy currents induced in the materials at radio frequencies cause too much loss.

For this reason, among others, the most promising high-permeability materials for use in implementations of my antenna are engineered materials comprising a distribution of isolated ferromagnetic particles suspended in a dielectric medium having high electric resistance and low electric permittivity. The particle size is selected to fall below the skin depth, i.e., the penetration depth of electromagnetic energy into the particle at the electromagnetic frequency of interest. In typical ferrous materials, for example, the skin depth is several micrometers at microwave frequencies.

It should be noted in this regard that many engineered magnetic materials are anisotropic. Anisotropic materials are not excluded as the constitutive material for the magnetic ring of my antenna. Indeed, the range of materials that are useful for implementations of my antenna will include at least some anisotropic magnetic materials.

Engineered magnetic materials are currently the subject of extensive research and development. Several materials suitable for use in implementations of my antenna have been reported, together with methods for their production.

For example, U.S. Pat. No. 3,540,047, which issued on Nov. 10, 1970 to R. M. Walser et al., and by reference is hereby incorporated herein in entirety, describes flakes of a nickel-iron or nickel-iron-cobalt alloy arranged in an array and suspended in an insulating medium to form a magnetic layer. A multiplicity of such layers are stacked in alternation with layers of the insulating medium to form a magnetic element.

In a disclosed embodiment, the flakes are formed by photolithographically etching a vapor-deposited metallic film about 0.01 micrometers thick, or by masking the film during deposition. Each flake is a 20 mil×95 mil rectangle, and the flakes are separated by 5-mil gaps. The thickness of the intervening dielectric layers is comparable to that of the magnetic layers. Various results were reported. For example, a magnetic susceptibility at 400 MHz having a real part equal to 177 and an imaginary part equal to 49 was reported for a stack comprising 20 magnetic and 19 dielectric layers of thickness 0.1 and 0.4 micrometers, respectively. In that example, the dielectric composition was reported as SiO, and the magnetic flakes had a nominal composition of nickel 0.80, iron 0.20.

More recently, a microforging method for producing small flakes of ferromagnetic material was reported in R. M. Walser and W. Kang, "Fabrication and Properties of Microforged Ferromagnetic Nanoflakes," *IEEE Trans. on Magnetics*, vol. 34 (July 1998) 1144-1146. As reported there, quasi-spherical shaped powders of Fe, $Fe_{83}Si_{17}$, and $Ni_{81}Fe_{19}$ with a maximum diameter of 44 micrometers and smooth, spherical Fe powders with a maximum diameter of 8 micrometers were microforged in a high-energy ball mill. In an optimized process, a yield greater than 95 wt % was obtained of flakes having a diameter-to-thickness ratio greater than 50.

For magnetic characterization, samples were made by transferring flakes from a roller adhesive-backed Mylar® tape, resulting in a high degree of planar orientation. Small-signal magnetic permeabilities were measured on the flake samples. The real part of the relative permeability was found to be about 42 over a frequency range from 1 MHz to more than 100 MHz. The imaginary part of the permeability was found to be near zero for the same frequency range.

It should be noted that the magnetic ring is not limited to a circular shape as depicted in FIG. 2. It is necessary only that the magnetic ring be conformed so as to support a circulating magnetic current. Accordingly, the ring may be square, hexagonal, octagonal, or of any of various other possible shapes. The ring may also be perforated, or contain gaps, or have other kinds of voids, provided that a circulating magnetic current is still supported.

Figure 7:
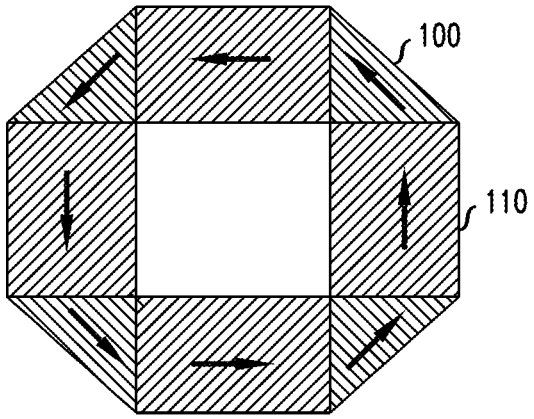
FIG. 7 is a simplified drawing of two non-circular implementations of the magnetic ring.
Figure 7:
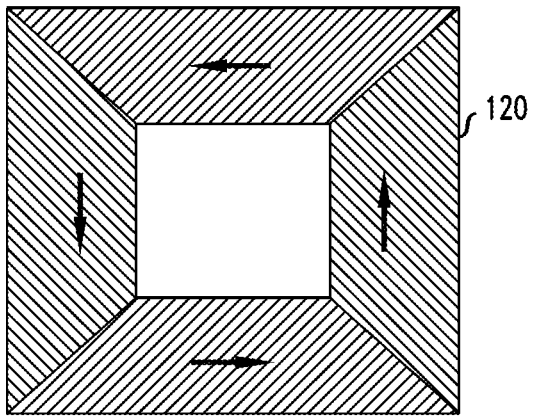

By way of example, FIG. 7 provides an example of an octagonal ring formed from triangular pieces 100 and rectangular pieces 110 cut from a sheet of magnetic material, and further provides an example of a square ring formed from trapezoidal pieces 120 cut from a sheet of magnetic material. The use of straight-sided sections cut from a sheet is advantageous because straight edges are generally easier to cut than curved edges, and there may be less wastage of material.

Another advantage of using straight-sided sections to construct the ring is that such an approach is compatible with the use of anisotropic materials. A magnetic material that is anisotropic has a high value of the magnetic permeability only along one or more specific directions within the material. For example, the direction of the magnetic field of the resonant mode in the ring of FIG. 6 is indicated by an arrow in each of the component sections. If the material is anisotropic and has, e.g., one axis of high magnetic permeability, that axis should be aligned parallel with the arrows as shown in the figure.

As noted above, the antenna implementation of FIG. 2 includes a ring structure resting on an extended ground plane. Such an arrangement may be described as a monopole structure above a ground plane. It should be noted that other implementations may take the form of a dipole structure, in which the ground plane is omitted and the magnetic ring is doubled in thickness, i.e., made equally high both above and below a median plane. By "median plane" is meant an equatorial, bisecting plane, i.e., a plane parallel to the ring that divides it into an upper half and an equal lower half.

In such dipole structures, the feed structure is preferably made symmetrical. That is, the feed plates (such as plates 61-64 of FIG. 2) are situated on both the top and the bottom of the magnetic ring. The center conductor of post 50 extends from the bottom to the top of the ring, and is fed at its center using a balance feed. If the antenna is fed from a conventional unbalanced transmission line such as a coaxial cable, a balun will typically be required to balance the feed.

What is claimed is:

1. An antenna having a radiation pattern or sensitivity pattern that is characteristic of a short electric dipole radiator having a dipole axis, comprising:

a ring of material disposed transversely to the dipole axis and having an average magnetic permeability more than ten times the magnetic permeability of air; and a feed structure adapted to couple radiofrequency energy into and/or out of a magnetic current circulating in the ring;

wherein:

the ring is the dominant radiative element of the antenna; the ring has a maximum diameter and a height as measured from a ground plane or, absent a ground plane, from a median plane of the ring; and the height is less than the maximum outer diameter.

2. The antenna of claim 1, wherein the antenna has at least one operating vacuum wavelength λ, and the height of the ring is no more than 0.02λ.

3. The antenna of claim 1, wherein the height of the ring is at most 0.04 times the maximum diameter.

4. The antenna of claim 1, wherein the height of the ring is no more than 0.02λ, the maximum diameter is no more than 0.5λ, and the ring comprises a material having a magnetic permeability selected to provide a Q-factor for the antenna of 20 or less.

5. The antenna of claim 1, adapted for mounting on a surface substantially perpendicular to the dipole axis.

* * * * *